US008464806B2

(12) United States Patent
Rousson et al.

(10) Patent No.: US 8,464,806 B2
(45) Date of Patent: Jun. 18, 2013

(54) FASTENING TOOL WITH DEPTH OF DRIVE ADJUSTMENT

(75) Inventors: Ludovic Rousson, Saint Lager Bressac (FR); Pierre Cordeiro, Livron sur Drome (FR); Alain Vettoretti, Bourg les Valence (FR); Patrick Herelier, Saint Jean de Muzols (FR)

(73) Assignee: Societe de Prospection et d'Inventions Techniques Spit, Bourg les Valance (FR)

( * ) Notice: Subject to any disclaimer, the term of this patent is extended or adjusted under 35 U.S.C. 154(b) by 243 days.

(21) Appl. No.: 12/963,700

(22) Filed: Dec. 9, 2010

(65) Prior Publication Data

US 2011/0139849 A1 Jun. 16, 2011

(30) Foreign Application Priority Data

Dec. 11, 2009 (FR) ..... 09 58903

(51) Int. Cl.
*B25C 1/18* (2006.01)

(52) U.S. Cl.
USPC ..... 173/142; 173/10; 173/119

(58) Field of Classification Search
USPC ..... 227/142, 9, 10, 119
See application file for complete search history.

(56) References Cited

U.S. PATENT DOCUMENTS 4,068,790 A * 1/1978 Osterle et al. ..... 227/8
4,389,012 A * 6/1983 Grikis et al. ..... 227/120
5,683,024 A * 11/1997 Eminger et al. ..... 227/8
5,699,948 A * 12/1997 Lee ..... 227/10
2002/0121540 A1 9/2002 Taylor et al.
2007/0057006 A1 3/2007 Moore et al.
2007/0090149 A1 4/2007 Segura et al.
2011/0062209 A1* 3/2011 Vallon et al. ..... 227/110

FOREIGN PATENT DOCUMENTS

EP 1798002 A1 6/2007
GB 2478784 A 9/2011
JP 2009178811 A 8/2009
WO 2009/096395 A1 8/2009

OTHER PUBLICATIONS

Office action Corresponding to CA2,724,967, dated Mar. 14, 2012.
Office Action corresponding to NZ589286, dated Mar. 29, 2012.
French Search Report for FR 0958903 dated Jun. 30, 2010.

* cited by examiner

*Primary Examiner* — Brian D Nash
(74) *Attorney, Agent, or Firm* — Lowe Hauptman Ham & Berner, LLP

(57) ABSTRACT

The tool comprises an engine for propelling a piston including a shaft for driving a fastening member into a supporting material and through a pin guide, with means for adjusting the depth of drive of the piston shaft outside the pin guide at the end of the propulsion and at the stop of the piston in abutment against stop means. The pin guide is mounted free in translation and the depth of drive adjusting means comprise an adjustment knurl with a knurl shaft arranged so as to be in abutment against the pin guide and to push the pin guide forwards under the rotation action of the knurl.

7 Claims, 2 Drawing Sheets

FASTENING TOOL WITH DEPTH OF DRIVE ADJUSTMENT

RELATED APPLICATIONS

The present application is based on, and claims priority from, French Application Number 0958903, filed Dec. 11, 2009, the disclosure of which is hereby incorporated by reference herein in its entirety.

TECHNICAL FIELD

The invention relates to a hand fastening tool of the nailing or stapling tool type, for instance.

BACKGROUND

Such a tool comprises what could be referred to as a propelling engine, arranged for driving in motion, under the firing action of a fuel (gas or powder, more particularly), a piston (or a weight) provided with a rod for driving a fastening member into a supporting material.

In the front part of the tool, there is a fastener guide wherein the fastener to be driven is arranged. Firing could only occur after the tool is being abutted, through the fastener guide, against the supporting material.

The penetration depth of the fastening member into the supporting material depends on the length thereof and on the length of the piston rod projecting outside the fastener guide at the end of the shot. It is thus understood that it was desired to adjust such a depth of drive as a function, precisely, of the length of the fastener, of the need to embed the head thereof into the supporting material, of the wish not to burst out the accessory, if it is to be fixed with the supporting material, or even and for instance, of the concern not to burst out the supporting material or not to form a scratched area.

There have already been suggested to provide depth of drive adjustment devices, but which are very complex. After a first part has been lifted, two screws are to be unscrewed, a key is to be moved, the screws are to be screwed again, and the part should be put back in position, all this occurring using tools.

The invention thus aims to provide a tool with a particularly simple adjustment device.

Thus, this invention relates to a hand fastening tool, comprising an engine for propelling a piston, comprising a shaft for driving a fastening member into a supporting material and through a pin guide, with means for adjusting the depth of drive of the piston shaft outside the pin guide at the end of the propulsion and stop of the piston in abutment against stop means, characterised in that the pin guide is mounted free in translation and the depth of drive adjusting means comprise a adjustment knurl with a knurl shaft arranged to be in abutment against the pin guide and to push the pin guide forwards under the action of the knurl rotation.

The position of the piston in the tool at the end of the propulsion, after a shot, being predetermined by the stopping means, the more the pin guide is pushed forwards, the more the depth of drive of the piston shaft is reduced.

It is to be noticed that if the operator, after a shot, notices that he had turned the knurl too much, before the following shot, he will turn the knurl in the opposite direction and, upon the new abutment of the tool, the pin guide will return back to be located in abutment against the knurl shaft in a better position.

It should be noticed that the tool of the application EP 1,934,018 also comprises a means for adjusting the depth of drive, with an adjustment knurl as well. But such a knurl directly cooperates with a sensor rod, as well in one direction as in the other one, the portion of the sensor rod cooperating with the knurl being threaded so as to get very accurate adjustments. The U.S. Pat. No. 5,385,286 discloses depth adjusting means of approximately the same type.

SUMMARY

In the preferred embodiment of the tool of the invention, the propelling engine is an internal combustion engine with fluid fuel and there is provided a combustion chamber able to be closed by means of a cage slidably mounted by a cage yoke on a tool barrel, wherein the pin guide is slidably mounted, the chamber and the cage being mutually integral, the adjustment knurl being mounted rotatably on the cage yoke.

Advantageously, the knurl shaft extends across a bridge of the cage yoke and driving in rotation the knurl drives the knurl shaft in translation across the bridge of the cage yoke.

Preferably, the front end of the knurl shaft comprises a rear abutment edge against the cage yoke.

The adjustment knurl could comprise a disk portion for rotation indexing arranged for resiliently cooperating with the cage yoke.

BRIEF DESCRIPTION OF THE DRAWINGS

This invention will be better understood from the following description of the preferred embodiment of the tool of the invention, with reference to the appended drawing, in which.

DETAILED DESCRIPTION

Figure 1:
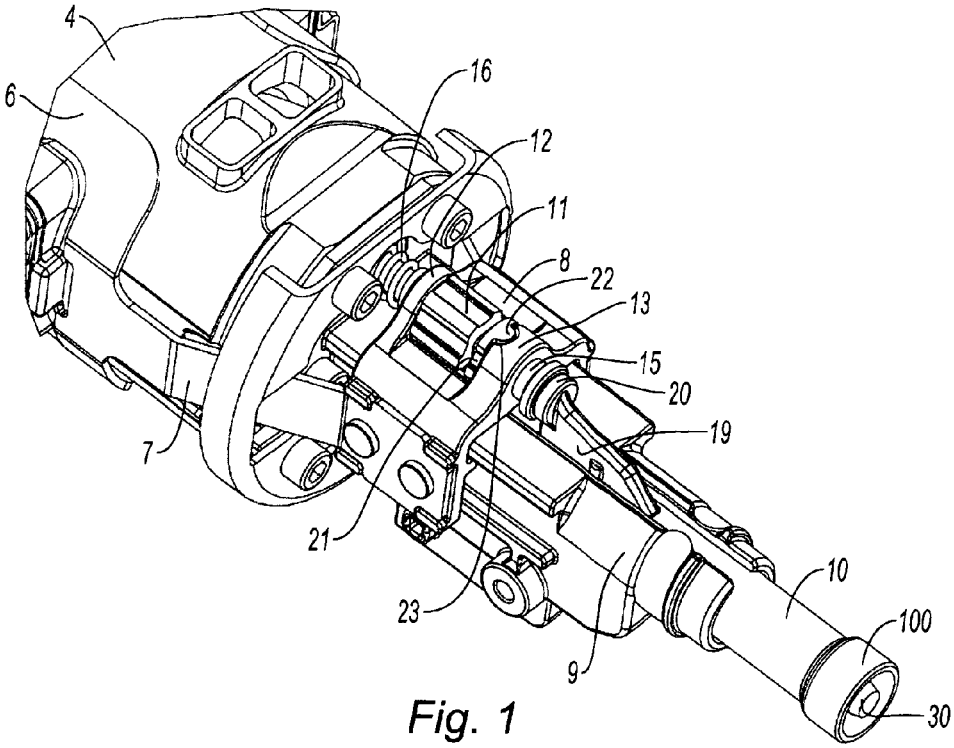
FIG. 1 is a perspective view of the front part of the tool, in a closed state, at the end of the piston propulsion after a shot, without any depth of drive of the piston outside the pin guide.

The hand tool that will be now described is a so-called gas nailer, i.e. that it comprises a combustion chamber wherein a mixture of fuel, thus here gaseous, and of an oxidizer, the air, is fired for propelling forwards a plunger, or a piston 1 which, in turn, drives a fastening member, in this case a nail, into a supporting material. The piston 1 comprises a head 2 and a shaft 3. The head 2 is mounted mobile in translation under the firing action of the mixture in a cylinder 4 until coming in abutment against a stop damper 5. Before firing, the combustion chamber is closed through shifting a cage 6, with which it is integral and extended by arms 7 fixed with a yoke 8. The piston shaft 3 is mounted mobile in translation in a barrel 9 extended forwards with a pin guide 10, here being telescopic, mounted free in translation in the barrel 9, and wherein, preliminarily to the shot, a nail has been introduced. The cage yoke 8 is slidably mounted around the barrel 9. The tool comprises a knurl 11 for adjusting the depth of drive of the front end 30 of the piston shaft 3 outside the front end 100 of the pin guide 10, such a depth of drive being adjusted after the shot, at the propulsion end, with the piston being stopped with its head 2 in abutment against the damper 5. On FIGS. 1 and 2, such a depth of drive has been adjusted to a nil value.

The knurl 11 is rotatably mounted between a rear bridge 12 and a front bridge 13 of the cage yoke 8 acting as bearings for a knurl shaft, a rear shaft portion 14 and a front shaft portion 15. The rear portion 14 of the knurl shaft acts as a guide for an abutment spring 16 of the chamber and prevents such a spring from buckling, the abutment of the chamber occurring at the closure of the chamber upon the abutment of the tool as well as upon the opening of the chamber.

The front shaft portion 15 of the knurl 11 comprises, at its end, a thrust disk 17 for the buffer guide 10, the peripheral edge of said disk forming a rear supporting edge 18 against the front bridge 13 of the cage yoke 8. For cooperating with the thrust disk 17 of the knurl shaft 15, the pin guide comprises a leg 19 ending at the rear with an abutment disk 20 for receiving the thrust of the disk 17 of the knurl shaft 15.

The adjusting knurl 11 is partially crosswise slit so as to exhibit, at the front, an indexing disk 21 resiliently connected with the remainder of the knurl in that the disk 21 could be distorted towards the rear, against the main part of the knurl, so as to reduce the width of the slit and release it from an indexing position. Indeed, the indexing disk 21 of the knurl 11 comprises an axially projecting boss 22 intended to become housed in a corresponding recess 23 of the front bridge 13 of the cage yoke 8.

When the knurl 11 is rotated, the knurl shaft is driven into translation forwards for driving as well the pin guide 10 forwards, by means of the thrust disk 17 of the front shaft portion 15 of the knurl, of the supporting disk 20 of the leg 19 of the pin guide 10 and through the front bridge 13 of the cage yoke 8.

Different possibilities can be contemplated for moving the knurl shaft into translation when the knurl is rotated. The front shaft portion 15 could be externally threaded and the front bridge 13 of the cage yoke 8 could be internally threaded, the shaft being rotated by the knurl 11 through lands, flutes, squares or another pin. Equivalent means could be contemplated as well, for instance a finger, on one or the other shaft of the two shaft and bridge members, being guided in a guiding path on the other of both members.

Thus, the knurl 11, by means of the front shaft portion 15, with the thrust disk thereof 17, allows pushing the leg 19 of the pin guide 10 forwards so as to reduce the distance between the end transversal planes of the front end 100 of the pin guide and the piston shaft 3. Again, should the pin guide move too far forwards, this could be compensated for by the following abutment of the tool.

Figure 2:
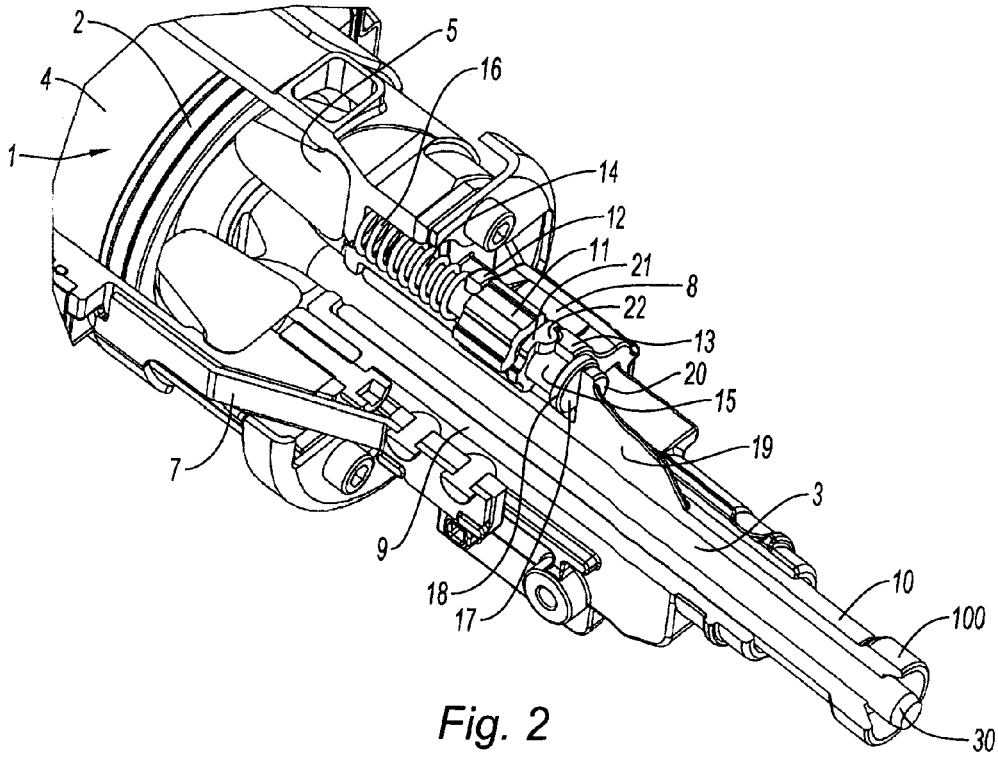
FIG. 2 is a view of the tool similar to that on FIG. 1, but with a one quarter axial section.

On FIGS. 1 and 2, the projection of the piston shaft 3 outside the pin guide has been adjusted to a nil value.

Figure 3:
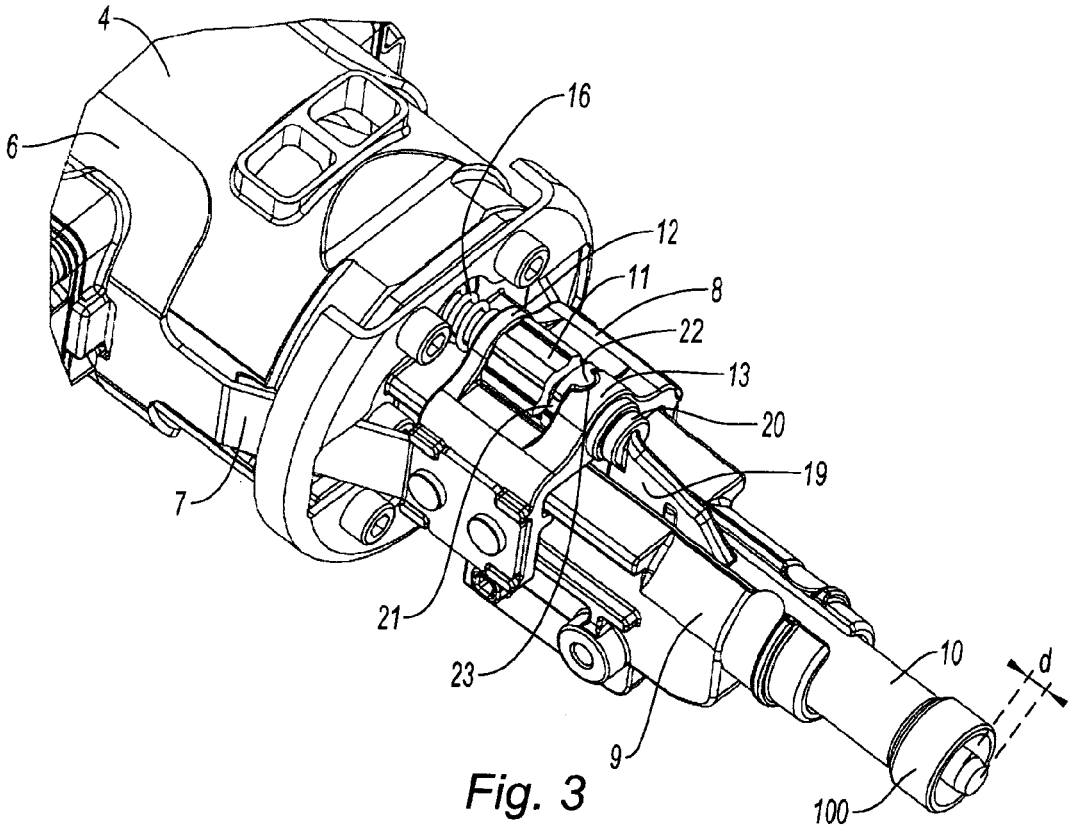
FIG. 3 is a view of the tool similar to that on FIG. 1, but with the piston projecting out of the pin guide.

On FIG. 3, where similar numerals refer to the similar elements as on FIGS. 1 and 2, the piston shaft 3, at the end of the propulsion and at stop, projects outside the buffer guide by a small axial distance d, obtained by a further rotation movement of the knurl 11.

It is to be noticed that for rotating the knurl 11 in one direction or the other, it is sufficient to push the indexing disk 21 back to the rear and to start rotating the knurl. The indexing positions of the knurl depend on the number of bosses 22 on the disk 21, and on the number of recesses 23 in the front bridge 13 of the cage yoke 8.

The invention claimed is:

1. A hand fastening tool, comprising an engine, a piston comprising a head, a damper, a piston shaft and a pin guide, the engine connected to the piston for driving a fastening member into a supporting material, the head capable of being in abutment against the damper, a means for adjusting the depth of drive of the piston shaft outside the pin guide as the head is in abutment against the damper, wherein the pin guide is mounted within the piston free in translation and the means for adjusting the depth of drive includes a rotatable adjustment knurl having a knurl shaft arranged to be in abutment against the pin guide and to push the pin guide forward under the rotation action of the knurl.

2. A fastening tool according to claim 1, further comprising a barrel, a cage, and a cage yoke, the cage fixed to the cage yoke and the cage yoke slidably mounted around the barrel, wherein the engine is an internal combustion engine, the engine having a combustion chamber able to be closed by the cage, wherein the pin guide is slidably mounted within the piston, the combustion chamber and the cage being mutually integral, the adjustment knurl being rotatably mounted on the cage yoke.

3. A fastening tool according to claim 1, wherein the cage yoke comprises a bridge, wherein the knurl shaft extends across the bridge of the cage yoke and the rotatable adjustment knurl capable of driving the knurl shaft in translation through the bridge of the cage yoke.

4. A fastening tool according to claim 1, wherein the knurl shaft comprises a rear edge in contact with the cage yoke.

5. A fastening tool according to claim 1, wherein the rotatable adjustment knurl comprises an indexing disk portion arranged for resiliently cooperating with the cage yoke.

6. A fastening tool according to claim 1, wherein the knurl shaft comprises a thrust disk in contact with the pin guide.

7. A fastening tool according to claim 6, wherein the pin guide comprises a leg having an abutment disk in contact with the thrust disk.

* * * * *